US006672226B2

(12) United States Patent
Bohnacker

(10) Patent No.: US 6,672,226 B2
(45) Date of Patent: Jan. 6, 2004

(54) BRACKET SYSTEM FOR SHELVING

(75) Inventor: Ulrich Bohnacker, Fruthwilen (CH)

(73) Assignee: Tegometall (International) AG, Lengwil (CH)

( * ) Notice: Subject to any disclaimer, the term of this patent is extended or adjusted under 35 U.S.C. 154(b) by 0 days.

(21) Appl. No.: 10/088,135

(22) PCT Filed: Jul. 9, 2001

(86) PCT No.: PCT/EP01/07870

§ 371 (c)(1),
(2), (4) Date: Jun. 13, 2002

(87) PCT Pub. No.: WO02/05684

PCT Pub. Date: Jan. 24, 2002

(65) Prior Publication Data

US 2002/0178976 A1 Dec. 5, 2002

(30) Foreign Application Priority Data

Jul. 18, 2000 (DE) ..... 200 12 436 U

(51) Int. Cl.[7] ..... A47B 9/00
(52) U.S. Cl. ..... 108/108; 108/152; 248/250
(58) Field of Search ..... 108/108, 147.11, 108/106, 107, 110; 248/250, 244, 235

(56) References Cited

U.S. PATENT DOCUMENTS 205,722 A * 7/1878 Brodie et al.
2,251,638 A * 8/1941 Sanford
3,355,134 A * 11/1967 Chesley
3,358,956 A * 12/1967 Thornton
3,533,514 A * 10/1970 Kellinger
4,378,925 A * 4/1983 Griffin
4,658,968 A * 4/1987 Mastrodicasa
4,660,477 A * 4/1987 Kortering et al.
4,669,692 A * 6/1987 Mastrodicasa
4,938,442 A * 7/1990 Mastrodicasa
5,406,894 A * 4/1995 Herrmann et al.
6,345,579 B1 * 2/2002 Zaturensky
6,505,800 B1 * 1/2003 Abdullah

FOREIGN PATENT DOCUMENTS

DE 29901320 * 6/1999
GB 2042876 * 10/1980

* cited by examiner

*Primary Examiner*—Jose V. Chen
(74) *Attorney, Agent, or Firm*—Barnes & Thornburg

(57) ABSTRACT

Shelving comprises uprights and horizontal bracket systems for supporting shelves. The present bracket system comprises two separate parts, a bracket and a retaining member. The bracket has an upper edge forming a support face for carrying a shelf. The retaining member comprises an anchoring section received in a receptacle in the bracket, and a locking section projecting over the support face for engagement with a shelf to prevent it from sliding on the support face.

4 Claims, 1 Drawing Sheet

BRACKET SYSTEM FOR SHELVING

BACKGROUND AND SUMMARY OF THE INVENTION

The invention relates to a bracket system for shelving.

Generally, shelving comprises uprights, substantially horizontal brackets (also called consoles) mounted to the uprights by engagement of hooks on the brackets with slots in the uprights, and shelves carried by the brackets. In the present text, the term shelf designates any means such as boards, grids, baskets or troughs which may carry objects placed and stored on the shelving.

The upper edge of the bracket forms a support edge or support face for carrying the shelf and is often provided with recesses or slits for engagement by respective ridges depending from the bottom of the shelf, to lock the shelf on the bracket against sliding back and forth, see DE-U-297 17 791 or GB-A-748 578. Some brackets are integrally formed with a hook projecting beyond the support edge, see DE-U-72 21 856 or FR-A-2 501 984. A small bore or recess is then provided at an appropriate position in the bottom of a wooden shelf or steel shelf, respectively, for engagement by the hook to prevent the shelf from sliding. Some systems have additional clips for insertion into the slots of the uprights to prevent a shelf from lifting off the brackets, see GB-A-2 194 134.

Brackets are generally made by punching from sheet metal to obtain sufficient load carrying capability at reasonable costs. The aforesaid hook prevents, however, to obtain a plurality of brackets directly adjacent each other from the same sheet metal. Instead, waste punchings remain between the brackets.

It is an object of the invention to provide a bracket system for shelving which can lock a shelf against sliding on the bracket and is economical to manufacture.

This object is solved by a bracket system as set forth in claim 1. The subclaims are directed to preferred embodiments of the invention.

The invention provides a retaining member separate from the bracket. The retaining member can be inserted into a receptacle in the bracket and projects over the support edge of the bracket where the bracket carries a shelf. It can thus retain the shelf against sliding on the bracket. The retaining member can be manufactured separately from the bracket. The support edge can thus be made without an outwardly projecting hook integrally formed therewith. Omission of the integral hook lowers the manufacturing costs. The bracket can also be used without a retaining member where fastening of the shelf is unnecessary or is achieved by other means.

Preferably, the retaining member is only plugged into the receptacle of the bracket.

A bracket made from punched or cut sheet metal in accordance with claim 2 is particularly economical. The separate retaining member has then the advantage that the support edge of the bracket can be straight without projections or slits, so that blanks for the bracket can be obtained side by side from sheet metal without much punching waste.

The U-shaped cross-section according to claim 3 has the advantage of high load carrying capacity and torsion resistance.

The implementations of the bracket and retaining member according to subclaims 3 and 4 are easy to manufacture and to assemble.

BRIEF DESCRIPTION OF THE DRAWINGS

The drawings show a preferred embodiment of the invention, wherein.

DETAILED DESCRIPTION OF THE PREFERRED EMBODIMENTS

Figure 1:
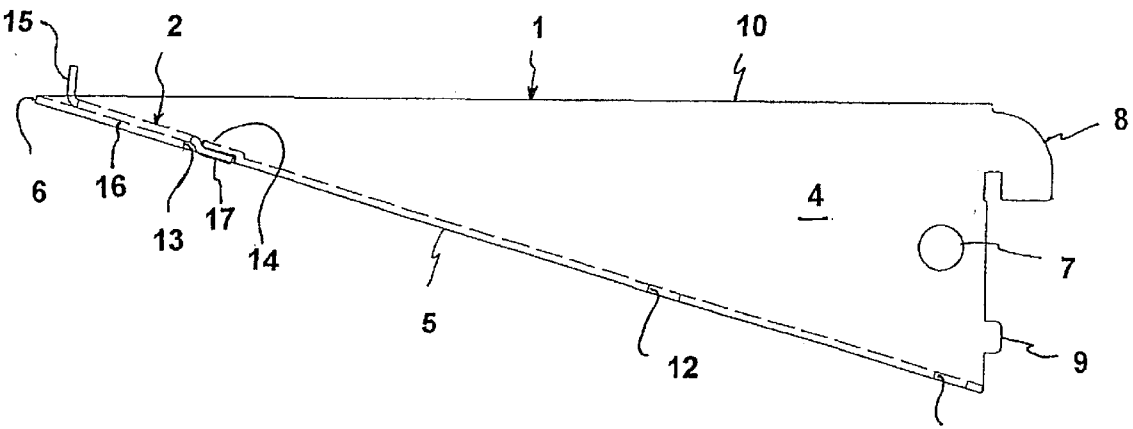
FIG. 1 is a schematic side view of a bracket system for shelving, comprising a bracket and a retaining member.
Figure 2:
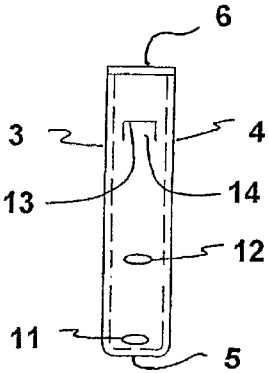
FIG. 2 is a front view of the bracket of FIG. 1.

The bracket system for shelving as shown in FIG. 1 comprises a bracket 1 and a retaining member 2. As shown also in FIG. 2, the bracket 1 has a U-shaped cross-section with two essentially triangular sidewalls 3, 4 and a bottom wall 5. The front view of FIG. 2 shows the front edge 6 of the bottom wall 5.

The sidewalls 3, 4 each have a hole 7 for hanging up the bracket 1 during painting, coating, transport or storage.

The sidewalls 3 and 4 are each formed with two hooks 8 and 9 on the rear side of the bracket 1 for engaging slots in an upright (column or wall rail, not shown) of the shelving.

The straight upper edges of the sidewalls 3, 4 each form a support edge 10 and together form a support face 10 on which a shelf (not shown) can rest. The bottom wall 5 has openings 11, 12 which may serve to screw the shelf to the bracket 1. An easier fastening of the shelf on the bracket 1 is, however, achieved by the retaining member 2.

The retaining member 2 is simply inserted or plugged into a receptacle 13, 14 in a front portion of the bracket 1. The receptacle comprises a recess 13 providing an opening in the bottom wall 5, and further comprises an impression 14 in the bottom wall 5 at the border of the recess 13.

Figure 3:
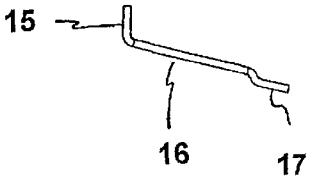
FIG. 3 is a side view of the retaining member of FIG. 1.
Figure 4:
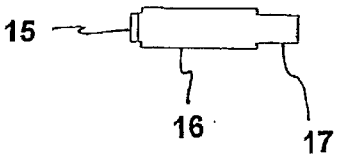
FIG. 4 is an elevational view of the retaining member.

Details of the retaining member 2 are shown in the side view depicted in FIG. 3 and the elevational view depicted in FIG. 4. The retaining member 2 is punched from a metal strip and bent substantially to an L-shape having two legs. One leg forms a locking section 15 for engagement with a respective recess in a shelf (not shown). The other leg comprises an elongated central section 16 with a distal end carrying a substantially Z-shaped anchoring section 17 for engagement with the receptacle 13, 14 of the bracket 1.

FIG. 1 shows the retaining member 2 inserted into the receptacle 13, 14 of the bracket 1. The central section 16 rests flat on the bottom wall 5 snugly fitting between the sidewalls 3 and 4, and the Z-shaped anchoring section 17 extends through the recess 13 with its distal end coming to lie under the inwardly directed impression 14, without substantially extending beyond the contour of the bracket 1. Hence, the retaining member 2 can be easily attached to the bracket 1 without affecting its look. And the retaining member 2 is hooked to the bracket 1 so as to be prevented from moving parallel to the support face 10. The locking section 15 of the retaining member 2 projects to above the support face 10 to engage a respective recess in a shelf (not shown) and arresting the latter against sliding on the support face 10, particularly against sliding lengthwise along the upper edges of the sidewalls 3, 4.

The bracket 1 is simply manufactured by punching a blank from sheet metal, canting or bending the side walls 3, 4 with respect to the bottom wall 5 and embossing the impression 14. A plurality of like brackets 1 can be commonly punched from one sheet metal with their long support edges lying directly adjacent each other without interference from hooks which extend from the support edges of many conventional brackets. The amount of punching scissels can thus be reduced and the manufacture is economical.

Hence, the present bracket system consists of two different parts, i.e. a bracket 1 and a retaining member 2. The retaining member 2 comprises an anchoring section 17 for insertion into a receptacle 13, 14 of the bracket 1 and comprises a locking section 15 for engagement with a shelf lying on a support face 10 of the bracket 1. The system is economical to manufacture and secures the shelf against sliding on the support face 10.

Although the present invention has been described and illustrated in detail, it is to be clearly understood that this is done by way of illustration and example only and is not to be taken by way of limitation. The spirit and scope of the present invention are to be limited only by the terms of the appended claims.

What is claimed is:

1. A bracket system for shelving, comprising a bracket having a U-shaped cross-section with a bottom wall and two side walls, and having an upper support edge for carrying a shelf, a retaining member having an anchoring section for insertion into a receptacle of the bracket and having a locking section projecting beyond the support edge when the anchoring section is inserted into the receptacle, and the retaining member being generally L-shaped and having one leg forming said locking section, and another leg carrying the anchoring section and resting on the bottom wall when the anchoring section is inserted into the receptacle.

2. A system according to claim 1, wherein the bracket is a cut or punched sheet metal part.

3. A system according to claim 1, wherein the retaining member is a punched sheet metal part and said anchoring section is a substantially Z-shaped distal end of said other leg.

4. A system according to claim 3, wherein the receptacle comprises a recess in the bracket and the retaining member is secured against sliding in a direction parallel to the support edge by interlocking engagement of the Z-shaped anchoring section with the recess.

* * * * *